US006162335A

United States Patent [19]

Jordan et al.

[11] Patent Number: 6,162,335

[45] Date of Patent: Dec. 19, 2000

[54] APPARATUS FOR SELECTIVELY ELECTROPLATING AN AIRFOIL

[75] Inventors: Christopher Patrick Jordan, Middletown; James Bailey Sprenkle, Guilford; Normand J Morneau, New Haven; Colin Lyle Cini, Glastonbury; Gary E Stasiewski, Wallingford; Foster Philip Lamm, S. Windsor; Steven Michael Ruggiero, Manchester; Tara Michele Barr, Middletown; Thomas Reginald Davis, Durham, all of Conn.

[73] Assignee: United Technologies Corporation, Hartford, Conn.

[21] Appl. No.: 09/268,186

[22] Filed: Mar. 15, 1999

Related U.S. Application Data

[62] Division of application No. 08/942,452, Oct. 1, 1997, Pat. No. 5,902,471.

[51] Int. Cl.[7] ..... C25D 17/06

[52] U.S. Cl. ..... 204/297.01; 204/224 R; 204/297 W

[58] Field of Search ..... 204/224 R, 286, 204/287, 297.01, 297; 118/500, 503, 504

[56] References Cited

U.S. PATENT DOCUMENTS 4,256,555 3/1981 Wilson et al. .

5,076,897 12/1991 Wride et al. ..... 205/110

5,389,228 2/1995 Long et al. ..... 205/110

5,486,281 1/1996 Gruver et al. ..... 205/110

5,702,574 12/1997 Foster et al. ..... 204/224 R 5,792,267 8/1998 Marszal et al. ..... 118/500

*Primary Examiner*—Kathryn Gorgos

*Assistant Examiner*—William T. Leader

*Attorney, Agent, or Firm*—Bachman & LaPointe, P.C.

[57] ABSTRACT

A process and apparatus for selectively electroplating the tip portion of an airfoil. The airfoil includes a root portion and a blade portion having a tip. At least part of the blade including the tip is coated with an insulating material. Insulating material is removed from the tip and the airfoil is mounted in a fixture so that the tip is exposed. The fixture is immersed in a sealing bath, and the fixture and at least a portion of the airfoil is encased in sealing material while leaving the tip exposed. The fixture is then immersed in an electroplating bath, the exposed tip is electroplated, and the fixture is removed from the bath. The fixture includes an elongated base member and a grip element supported on the base member. The grip element is made of a flexible material and has a plurality of slots configured for receiving the root portion of the airfoils. An electrical contact is provided in each slot so as to contact the root portion of the airfoil. A plurality of fixture may be mounted on a carousel.

8 Claims, 4 Drawing Sheets

APPARATUS FOR SELECTIVELY ELECTROPLATING AN AIRFOIL

This is a Division, of application Ser. No. 08/942,452 filed Oct. 1, 1997, now U.S. Pat. No. 5,902,471.

BACKGROUND OF THE INVENTION

The present invention resides in an improved process and apparatus for the electroplating of airfoils used in turbines and the like.

Airfoils, which are used in jet engine environments, are generally required to have the tip portion thereof coated with a wear-resistant and corrosion-resistant material. Typical coating processes and apparatus require the masking of the airfoils in a coating fixture prior to the electroplating of a protective material on the tip portion of the airfoil blade. The fixtures previously used suffer from a number of disadvantages. These disadvantages include chemical contamination due to dragout in the plating baths, clumsiness of assembly of the supporting fixture for the airfoils, and limited capacity, that is limited number of airfoils processed per batch. Naturally, it would be highly desirable to provide an improved process and apparatus for plating the tip portion of airfoils. More particularly, it would be highly desirable to have a process and apparatus which reduces chemical contamination, increases product throughput, and reduces product cost.

Accordingly, it is a principle object of the present invention to provide a process for plating the tip portion of airfoils which is both efficient and economic.

It is a further object of the present invention to provide an apparatus for use in the plating process which increases throughput, reduces chemical causing contamination by dragout, and is simple to use.

Further objects and advantages of the present invention will appear hereinbelow.

SUMMARY OF THE INVENTION

The present invention is drawn to an improved process for electroplating the tip portion of an airfoil and an improved apparatus for use in the process.

The process of the present invention for electroplating the tip portion of an airfoil comprises providing an airfoil having a root portion and a blade portion, the blade portion having a tip remote from the root portion; coating at least part of the blade portion including the tip with an insulating material to produce a partially insulated coated airfoil; removing the insulating material from the tip of the blade portion to be electroplated; mounting the airfoil with exposed tip in a fixture wherein the airfoil contacts an electrical contact; immersing the fixture with airfoil in a sealing bath so as to sealingly encase the fixture and at least a portion of the insulated coated airfoil while leaving the tip exposed to form a fixture assembly with a partial sealant coating; immersing the fixture assembly in an electroplating bath for electroplating the tip of the airfoil; and removing the fixture assembly from the bath.

In accordance with the apparatus of the present invention, a fixture for supporting a plurality of airfoils is employed which comprises an elongated base member; grip means supported on the elongated base member for holding the airfoils, said grip means comprises a flexible material defining a plurality of configured slots for receiving the configured root portion of the airfoils and gripping same, each of the configured slots is provided with an electrical contact biased so as to contact the root portion of the airfoil when the airfoil is received in the configured slot. The fixture is mounted on a rotatable carousel having a plurality of sides wherein each of the plurality of sides is provided with at least one shaped insert for receiving the bottom surface of the fixture.

Further objects and advantages of the present invention will appear hereinbelow with reference to the detailed description.

DETAILED DESCRIPTION

With reference to the drawings, an airfoil 10 has a root portion 12 and a blade portion 14. The blade portion 14 is integral with the root portion 12 and has a tip portion 16 which, depending on the environment to which the airfoil will be exposed, is coated with a wear-resistant, corrosion-resistant coating.

In preparing the airfoil 10 for tip coating by electroplating processes, the blade portion 14 of the airfoil is coated with an insulating material. In the process of the present invention the insulating material is preferably an UV curable material for minimum cycle time; however, it should be appreciated that other insulating materials known in the prior art may be employed such as vinyl ester, polyester, polyimide, epoxy, et al. The preferred UV curable materials are manufactured and sold by Dymax Corporation under product designations 29601 through 29608. The portion of the blade which must be coated with the insulating material is the portion immediately adjacent the tip portion of the airfoil which will be subsequently electroplated. The root portion of the blade is not insulated as it is the root portion which will provide the electrical contact for the airfoil during electroplating. Accordingly, the blade may be coated with the insulating material by immersing the blade in a bath of the insulating material. In the case of the preferred UV-curable insulating material mentioned above, the blade is immersed in same so as to cover the critical portion of the blade and thereafter removed from the bath. The UV insulating material is then cured so as to form a hardened insulating coating on the blade.

After the insulating coating is applied as described above, the tip portion 16 of the airfoil 10 is prepared for electroplating by removing the layer of insulating material therefrom. This tip preparation is carried out by, for example, mechanically removing the insulating material by grinding or the like. Naturally, other methods may be used as known in the art such as chemical stripping. Furthermore, it should be recognized that the tip portion of the blade could be masked prior to exposing the blade to the insulating material bath thereby eliminating the need to remove the insulating material from the tip portion. However, masking has proved to be quite difficult and, therefore, not preferred for the process of the present invention.

Figure 4:
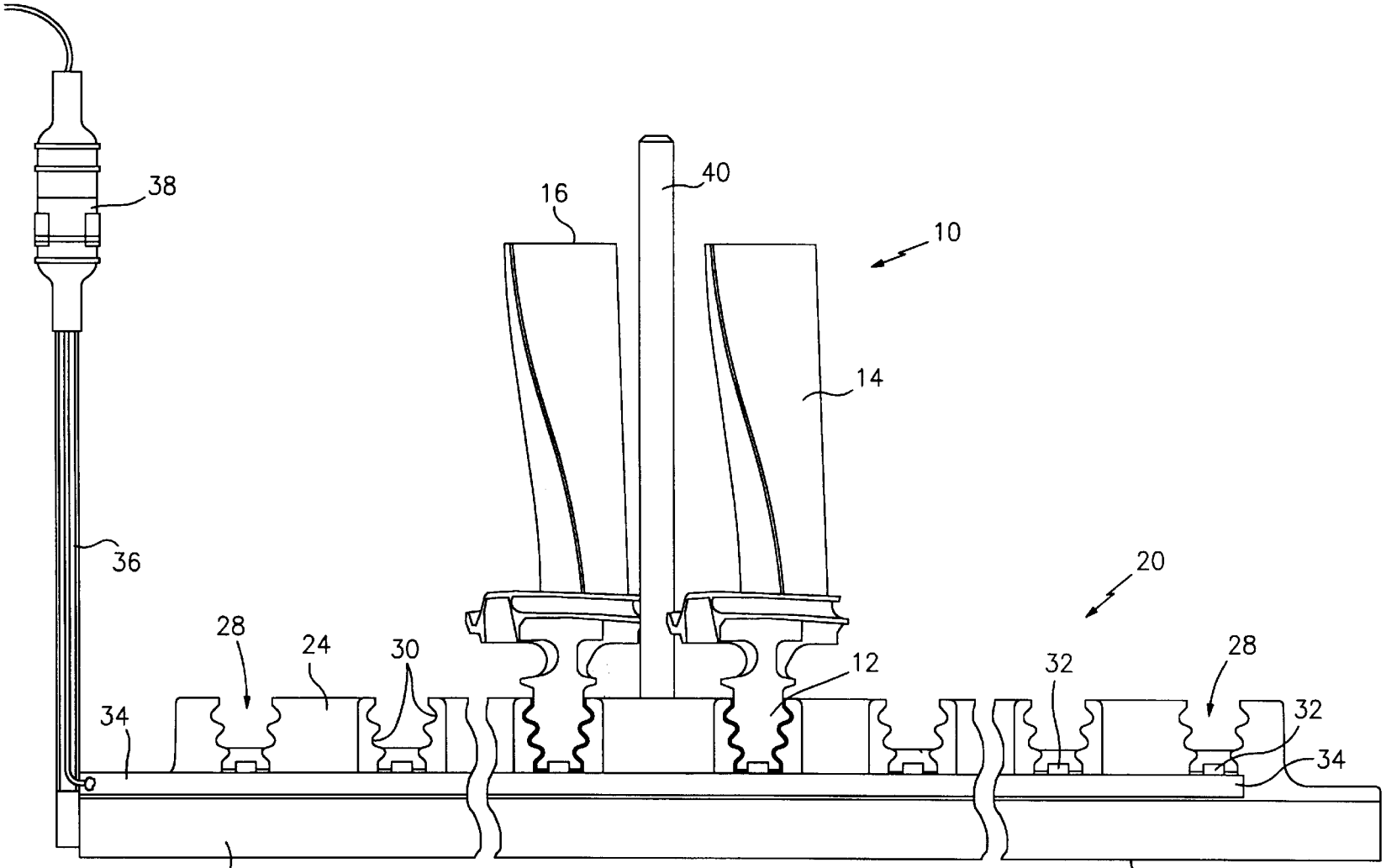
FIG. 4 is an enlarged view of a fixture for supporting airfoils in the assembly of FIG. 2.

The airfoil prepared in the manner described above is now ready to have the tip portion electroplated. With reference to FIG. 4, there is illustrated a plating fixture 20 in accordance with the present invention for supporting a plurality of airfoils 10 for electroplating. The fixture 20 includes an elongated base member 22 and a root support portion 24 for gripping and supporting the airfoil as described below. The base portion 22 is formed of a relatively hard insulating material such as silicone, neoprene, acrylic, et al. The underside 26 of the elongated base member 22 is shaped to correspond to the shape of a carousel (see FIG. 2) for supporting the fixture during electroplating in a manner to be described hereinbelow. The root support portion 24 is supported on the elongated base member 22 and includes a plurality of gripping slots 28 each for gripping and holding the root portion of an airfoil. As can be seen with reference to FIG. 4, each of the gripping slots 28 has an internal configuration 30 on the opposed sidewalls for each slot similar to the configuration of the root portion for receiving same. The root support portion 24 is also formed of an electrical insulating material; however, the material must have sufficient resiliency so as to grip the root portion of the airfoil and hold same in the fixture. Accordingly, the size of the gripping slots 28 must be smaller than the root portion dimension being gripped. Suitable materials from which the root support portion 24 may be formed include any of a number of castable silicone rubbers.

Provided on the bottom wall of each of the gripping slots 28 are electrical contacts 32 which, as can be seen in FIG. 4, are connected to a central electrical contacting member 34 provided on plating fixture 20 and supported and insulated by sealant coating 15 as described in detail hereinbelow. Contacting member 34 leads to upright 36 which is provided with connection 38 for attachment to a source of electricity as will be described. Fixture 20 further includes a rod 40 which serves as a support for the fixture when immersed in the sealing bath as described hereinbelow.

Figure 1:
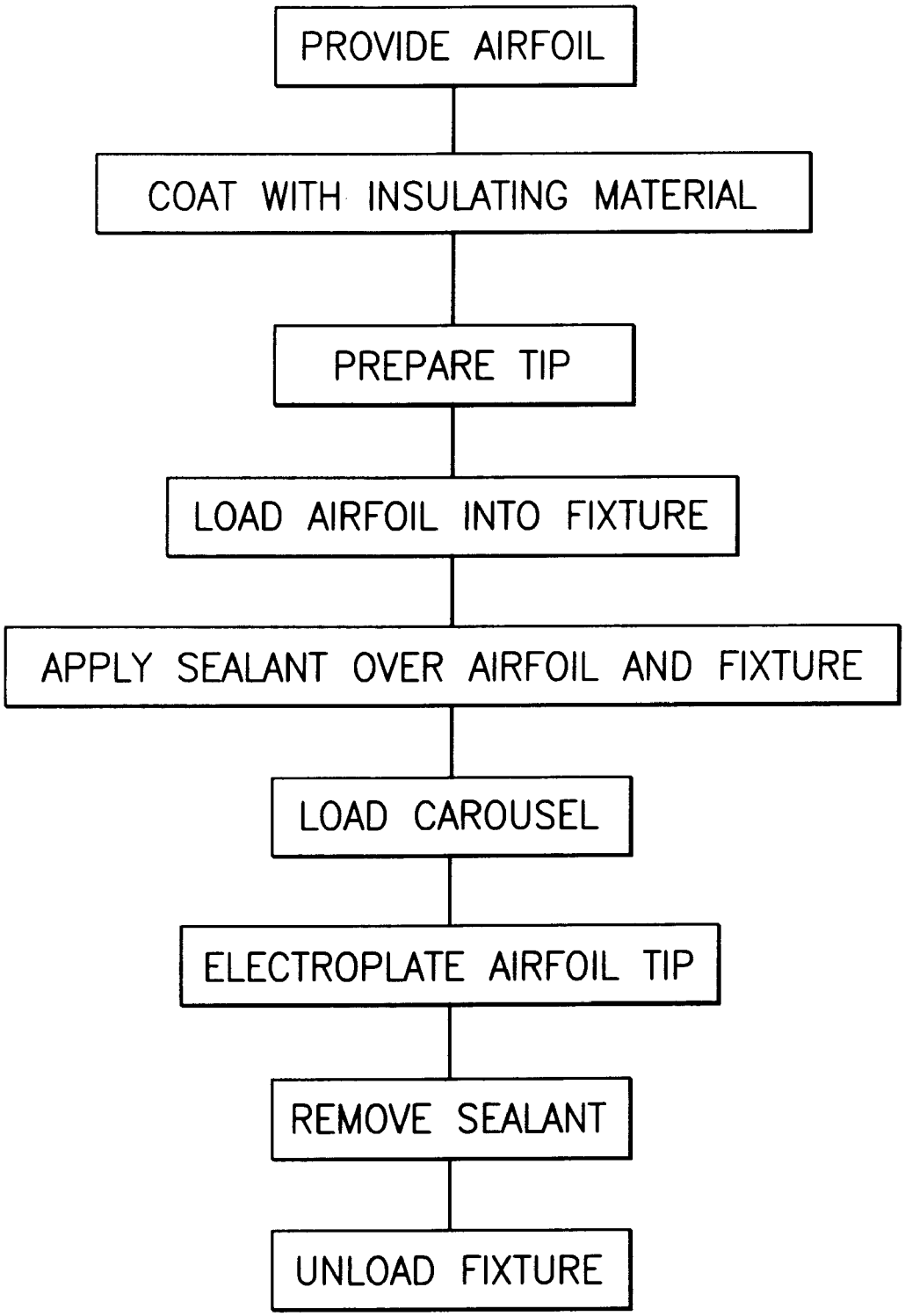
FIG. 1 is a process flow diagram of the process of the present invention.
Figure 5:
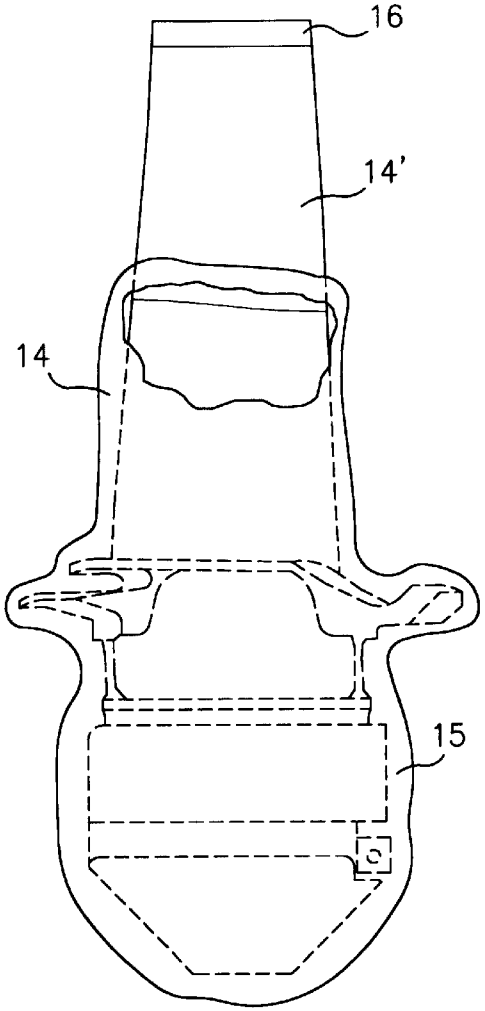
FIG. 5 is an enlarged sectional view through the fixture of FIG. 4 showing the airfoil and fixture prepared in accordance with the process of the present invention for further electroplating.

Referring to the process flow diagram of FIG. 1, once the fixture 20 is loaded with the airfoils 10, the loaded fixture is immersed in a sealing bath to encase the fixture 20 and at least a portion of the blade portion of the airfoil coated with the insulating material so as to leave exposed only the tip portion of the airfoil to be electroplated. The fixture is supported in the sealing bath by means of rod 40. Thus, as can be seen in FIG. 5, the airfoil 10, after immersion in the sealing bath has an exposed tip portion 16, a blade portion 14' adjacent the exposed tip portion which is coated with an insulating material (preferably an insulated curable material) and a sealant coating 15 which envelopes the fixture, root portion of the airfoil and a portion of the blade portion wherein the sealant coating overlaps the insulating material so as to leave only the tip of the blade exposed for electroplating. The sealant material is preferably a thermoplastic material which can be heated to a liquid state to form the bath and air cured to solidify. The material must remain solid during the plating process. Finally, when exposed to elevated temperatures in excess of the temperatures of the plating solutions during plating, the sealant should soften so as to be easily removed after electroplating. Suitable sealant materials include any number of hot melt thermoplastic coatings or adhesives that can be polyolefin, polyemide or acrylic based. A preferred material is manufactured and sold by Thermo Cote, Inc. under designation Thermo Cote N-4 (55).

Figure 2:
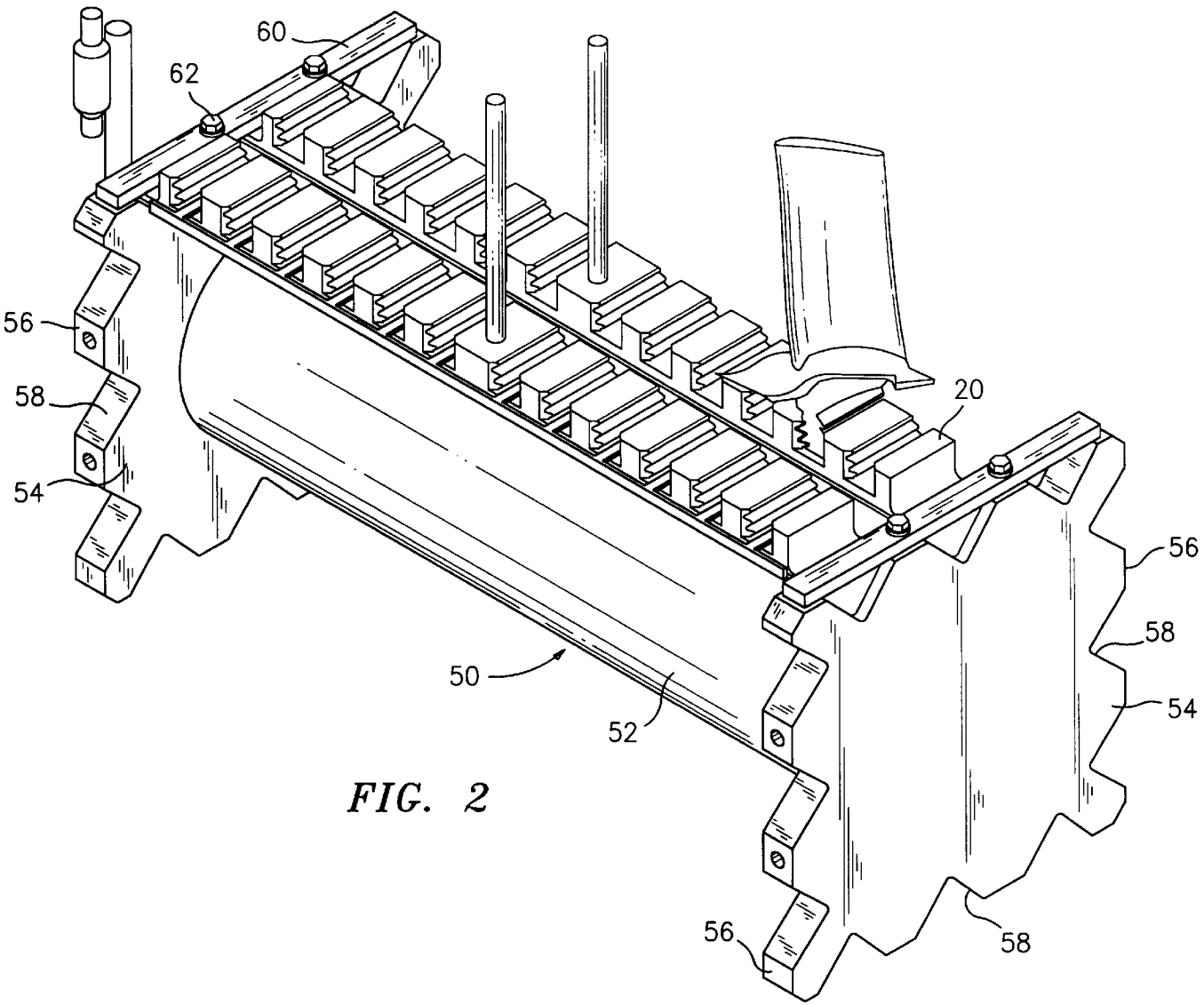
FIG. 2 is a perspective view of the assembly of the present invention for use in the process of the present invention.
Figure 3:
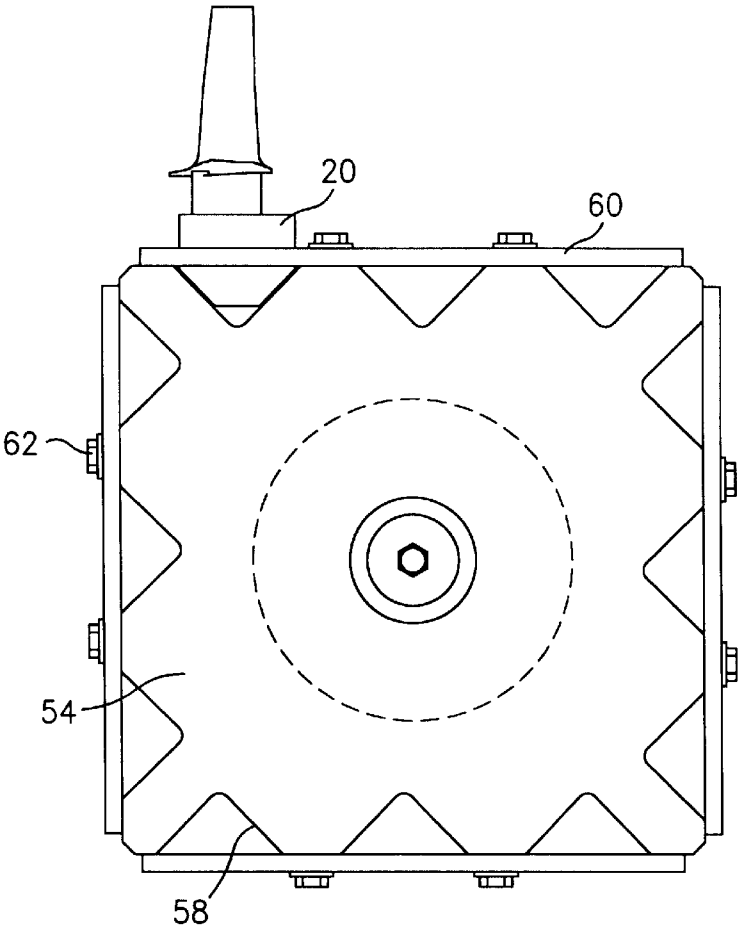
FIG. 3 is an end view of the assembly of FIG. 2.

With reference to FIGS. 2 and 3, after the fixtures 20 are coated with the sealant material as described above, they are mounted in carousel 50 for insertion into the plating solution. Carousel 50 has a central cylindrical portion 52 provided on its end with walls 54. The walls 54 are substantially square in shape and having four side surfaces 56 which are provided with a plurality of shaped recesses 58. The shaped recesses are formed with a shape corresponding to the shape of the underside 26 of elongated base member 22 for receiving base member 22 in a stable manner. As shown in FIG. 2, each side surface 56 is provided with three shaped recesses 58. It should be appreciated that the number may vary depending on the size of the plating tanks. The fixtures 20 are held in place in the shaped recesses 56 by brackets 60 secured to the side surfaces 56 of the walls 54 by bolts 62 or the like.

Once the carousel 50 is loaded, it is loaded in the electroplating solution and the electroplating process is carried out in a known manner as is known in the art. The advantages of the carousel assembly of the present invention are the following: substantial elimination of plating bath contamination, ease of assembly of airfoil support apparatus and reduction of cycle time.

Upon completion of the plating process, the carousel 50 is removed from the plating solution and the fixtures are removed from the carousel (see FIG. 1). The fixtures are thereafter heated to soften the sealant material. In the case of the preferred sealant material the fixtures are heated to a temperature of 230° F. and heated for sufficient time, about 15 minutes, to soften the sealant material so that it may be easily peeled off the fixture and airfoil. The airfoils are then removed from the fixtures for final use.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. A fixture for supporting a plurality of airfoils having a configured root portion and a blade portion to be electroplated comprises:

an elongated base member;

grip means supported on the elongated base member for holding the airfoils, said grip means comprises a flexible material defining a plurality of configured slots for receiving the configured root portion of the airfoils and gripping same, each of the configured slots is provided with an electrical contact biased so as to contact the root portion of the airfoil when the airfoil is received in the configured slot.

2. A fixture according to claim 1 wherein the configured slots include opposed sidewalls and a bottom wall wherein the opposed sidewalls are configured to receive the configured root portion of the airfoil and the bottom wall carries the electrical contact.

3. A fixture according to claim 1 further including a support rod extending substantially perpendicular to the elongated base member.

4. A fixture according to claim 1 wherein said grip means is formed of a resilient, electrical insulating material.

5. A fixture according to claim 1 wherein the electrical contact in each configured slot is connected to a central electrical contacting member extending within the elongated base member.

6. An assembly for plating a plurality of airfoils comprises:

a rotatable carousel having a plurality of sides, each of the plurality of sides having at least one shaped receiving means;

fixture means mounted in the receiving means on the sides of the carousel, the fixture means comprises an elongated base portion having a bottom surface corresponding to the shaped receiving means and a top surface provided with a grip means; and at least one airfoil secured in said grip means.

7. An assembly according to claim 6 wherein said gripping means comprises a flexible material defining a plurality of configured slots for receiving a configured root portion of the at least one airfoil, each of the configured slots having an electrical contact so as to contact a root portion of the airfoil when the airfoil is received in the configured slot.

8. An assembly according to claim 7 wherein the configured slots include opposed sidewalls and a bottom wall wherein the opposed sidewalls are configured to receive the configured root portion of the airfoil and the bottom wall carries the electrical contact.

* * * * *